US008281868B2

(12) United States Patent
Angman

(10) Patent No.: US 8,281,868 B2
(45) Date of Patent: Oct. 9, 2012

(54) TORQUE TRANSMITTING LOAD SHOULDER

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 430 days.

(21) Appl. No.: 12/701,404

(22) Filed: Feb. 5, 2010

(65) Prior Publication Data

US 2011/0192614 A1 Aug. 11, 2011

(51) Int. Cl.
*E21B 23/01* (2006.01)
*E21B 7/20* (2006.01)

(52) U.S. Cl. ..... 166/382; 166/73; 166/237; 175/171

(58) Field of Classification Search ..... 166/382, 166/73, 237, 240, 358, 348; 175/171, 257
See application file for complete search history.

(56) References Cited

U.S. PATENT DOCUMENTS

| | | | | |
|---|---|---|---|---|
| 3,556,216 | A | 1/1971 | Condra | |
| 4,256,179 | A | 3/1981 | Shillander | |
| 4,489,781 | A | 12/1984 | Weeks | |
| 4,496,000 | A | 1/1985 | Weeks | |
| 4,821,818 | A * | 4/1989 | Mefferd | 175/323 |
| 5,018,582 | A | 5/1991 | Baker | |
| 5,086,843 | A | 2/1992 | Mims et al. | |
| 5,125,148 | A * | 6/1992 | Krasnov | 29/426.6 |
| 5,839,524 | A | 11/1998 | Sanford | |
| 6,634,424 | B2 | 10/2003 | Knowles | |
| 7,475,742 | B2 | 1/2009 | Angman et al. | |
| 7,975,771 | B2 * | 7/2011 | Ford | 166/358 |
| 2002/0070032 | A1 | 6/2002 | Maguire et al. | |
| 2005/0257935 | A1 | 11/2005 | Craig | |
| 2005/0287854 | A1 * | 12/2005 | Shears et al. | 439/157 |
| 2006/0096787 | A1 * | 5/2006 | Underwood et al. | 175/294 |
| 2010/0122849 | A1 * | 5/2010 | Salzer et al. | 175/57 |

FOREIGN PATENT DOCUMENTS

GB 2 123 523 A 2/1984

OTHER PUBLICATIONS

Thomas, Casey, "PCT International Search Report," Canadian Intellectual Property Office, May 24, 2011, 3 pgs.

* cited by examiner

*Primary Examiner* — Daniel P Stephenson
(74) *Attorney, Agent, or Firm* — Osha Liang LLP

(57) ABSTRACT

A well drilling tool has a tubular member connected into a casing string that serves as a drill string. A load shoulder is located within the bore of the tubular member. The load shoulder has a torque transferring portion that extends from a lower terminus to an upper terminus. The load shoulder has an axial force transferring portion that faces upward. A bottom hole assembly is lowered through the casing string and lands on the load shoulder. The bottom hole assembly has a mating profile to the load shoulder so that it will be supported by the load shoulder and will receive torque transferred from the load shoulder.

20 Claims, 3 Drawing Sheets

TORQUE TRANSMITTING LOAD SHOULDER

FIELD OF THE INVENTION

This invention relates in general to well tools and particularly to a load shoulder located within a wellbore tubular member that is capable of transmitting torque as well as transmitting an axial load.

BACKGROUND OF THE INVENTION

Load shoulders are often used in wellbores to support various tools and equipment. A load shoulders is typically a conical or flat surface that encircles a bore within a tubular member. A load shoulder, also called a "no-go" shoulder, prevents tools having diameters larger than the inner diameter of the load shoulder from passing through. The load shoulder has the capacity to support the weight of the tool or device that lands on it.

A load shoulder is employed wherein wells are drilled by a method called casing-while-drilling. In this method, rather than a string of drill pipe being employed to drill the well, the operator drills the well with a string of casing or liner, and the casing or liner is subsequently cemented in the well. The term "casing" refers to well pipe that is cemented in the well and extends all the way to the wellhead. The term "liner" refers to pipe that is cemented in the well but extends only a short distance above the lower end of a previously installed string of casing. For convenience, both casing and liner will be referred to herein as casing. In the casing-while-drilling technique, a sub or tubular member is connected into the casing string near or at the lower end of the casing string. The tubular member has a no-go shoulder located within its bore.

The operator lowers a bottom hole assembly ("BHA") into the casing string. The BHA has a profile that will land on the no-go shoulder. A lower portion of the BHA extends through the no-go shoulder and out the lower end of the casing. A drill bit and optionally other equipment are located on this lower portion. Typically the BHA has a connector member that includes dogs that extend out and engage an annular recess in the tubular member to prevent the BHA from moving upward from the no-go shoulder when the casing string weight is imposed on the drill bit during drilling. Also, torque needs to be transmitted from the casing string to the BHA. Typically, spring-biased dogs are employed to spring out and engage circumferentially spaced-apart recesses or splines located in the bore of the tubular member. The operator employs a casing gripper at the surface to grip the casing and rotate it. The casing gripper attaches to a top drive of the drilling rig.

While this type of casing drilling is successful, the spring-biased dogs that serve to transmit torque from the casing to the BHA add some complexity to the BHA. Also, in small diameter wellbores, there may be inadequate room to mount spring biased dogs for transmitting torque.

SUMMARY OF THE INVENTION

The well apparatus of this invention includes a tubular member that locates in the wellbore and may be connected into and form part of a casing string employed for casing-while-drilling. The tubular member has a bore with a load shoulder located within it. The load shoulder has a torque transferring portion that extends upward from a lower terminus to an upward terminus. The torque transferring portion faces generally into a selected rotational direction relative to an axis of a tubular member. The load shoulder also has an axial force transferring portion that faces upward for transferring axial force.

A BHA that is lowered through the casing string has a profile that lands on the load shoulder. The profile has a torque transferring portion that mates in flush contact with the torque transferring portion of the load shoulder, so that the torque imposed on the casing string transfers to the BHA. The profile also has an axial load transferring portion that mates in flush contact with the axial load transferring portion of the load shoulder for transferring weight of the casing string to the BHA.

The load shoulder may be formed on a sleeve that is rigidly attached to the tubular member within the bore of the tubular member. In some of the embodiments, the torque transferring portion is substantially parallel with an axis of the tubular member. In other embodiments, it is inclined. The axial force transferring portion may comprise a helical surface extending 360 degrees from the lower terminus to the upper terminus of the torque transferring portion. Alternately, the load shoulder may have a sawtooth configuration with peaks and valleys defining the upper terminus and lower terminus. The flanks between the valleys and peaks comprise the torque transferring portions. The flanks may be parallel to the axis of the tubular member or they may be inclined at an angle. The axial force transferring portions are at the valleys of the load shoulder.

Preferably the BHA has a latch that mounts to the BHA and engages a recess in the tubular member when the profile lands on the load shoulder. The latch prevents upward movement of the BHA relative to the casing string.

DETAILED DESCRIPTION OF THE INVENTION

Figure 1:
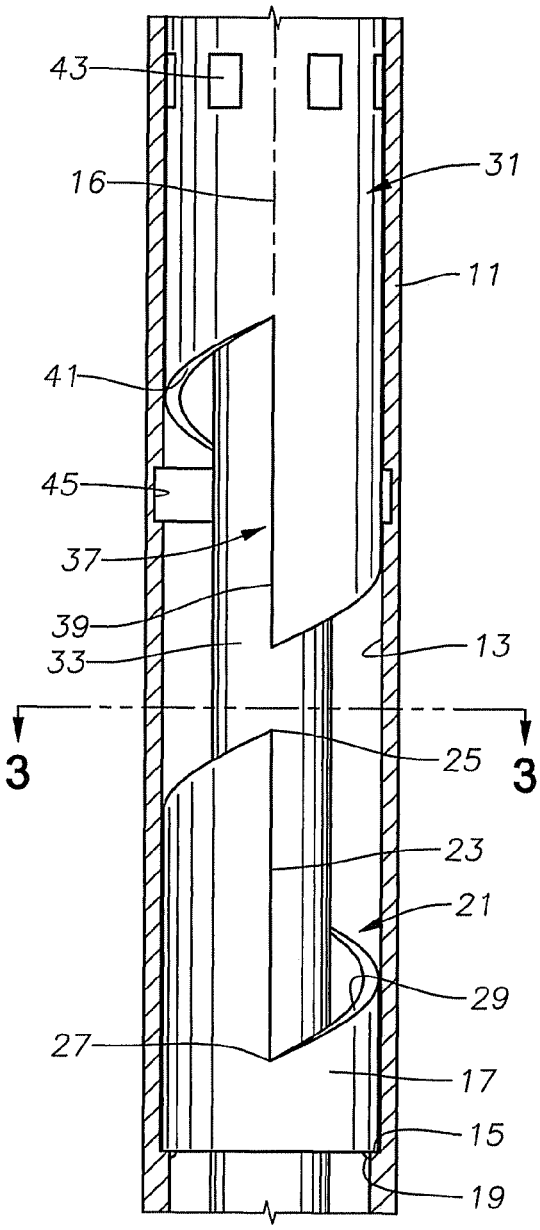
FIG. 1 is a sectional view illustrating a bottom hole assembly being lowered into engagement with a load shoulder, the bottom hole assembly having a profile that matches the load shoulder, the profile of the load shoulder being configured in accordance with this invention.

Referring to FIG. 1, tubular member 11 has a bore 13 with an upward facing no-go shoulder 15 located in it. Shoulder 15 is located in a single plane that is perpendicular to an axis 16 of bore 13.

A sleeve 17 has a lower end that is in contact with no-go shoulder 15. Sleeve 17 has an outer diameter that is greater than the inner diameter of no-go shoulder 15. In this example, the outer diameter of sleeve 17 is substantially the same as the inner diameter of bore 13 above no-go shoulder 15. Sleeve 17 is rigidly attached to tubular member 11 so that it will transmit torque as well as resist upward and downward movement within bore 13. Sleeve 17 may be attached to tubular member 11 in various manners, and in this embodiment, a weld 19 is shown attaching the lower end of sleeve 17 to no-go shoulder 15. Alternately, sleeve 17 could have splines or keys that engage mating grooves in bore 13 or vice-versa for transmitting torque.

Figure 4:
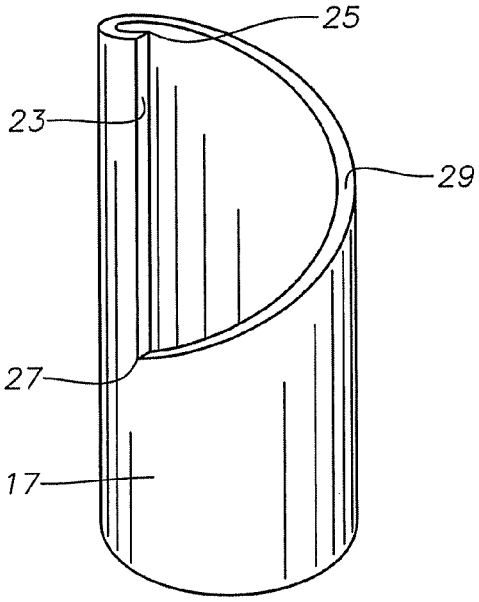
FIG. 4 is a perspective view illustrating the sleeve having the load shoulder in FIG. 1.

As shown also in FIG. 4, sleeve 17 has a load shoulder 21 formed on its upper end. Load shoulder 21 has a torque transfer portion 23 which has an upper terminus 25 and a lower terminus 27. In this example, torque transfer portion 23 is a straight edge surface that is parallel with axis 16. However, it could be inclined. If parallel to axis 16, upper terminus 25 will be directly above lower terminus 27 as shown. Torque transfer portion 23 faces into the direction that tubular member 11 will be rotated during operation.

Load shoulder 21 also has an axial load transfer portion 29. The axial load transfer portion 29 in this example is a helical edge that faces and slopes upward from lower terminus 27 to upper terminus 25. The lowest point of axial load transfer portion 29 joins lower terminus 27. The uppermost point of axial load transfer portion 29 joins upper terminus 25. A helical angle relative to axis 16 is selected so as to provide a desired axial length for load transfer portion 23. The circumferential extent of axial load transfer portion 29 from lower terminus 27 to upper terminus 25 is 360 degrees about axis 16. The thickness of torque transfer portion 23 is the same as the thickness of axial load transfer portion 29, which is the wall thickness of sleeve 17. Rather than a separate sleeve 17 being installed in bore 13, load shoulder 21 could be machined directly into bore 13 of tubular member 11.

Figure 2:
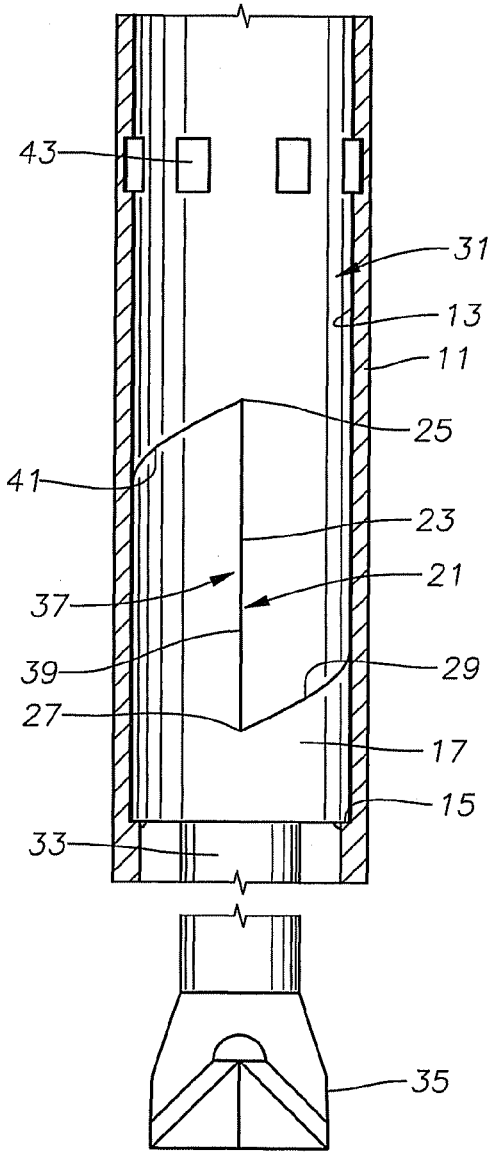
FIG. 2 shows a portion of the bottom hole assembly and load shoulder of FIG. 1, with the bottom hole assembly in the landed position.
Figure 3:
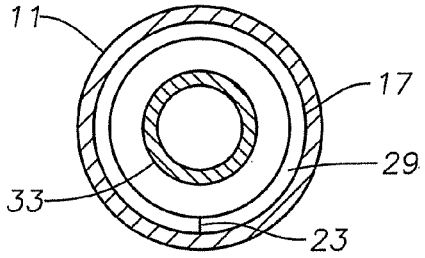
FIG. 3 is a sectional view of the apparatus of FIG. 1, taken along the line 3-3 of FIG. 1.

Referring again to FIG. 1, a bottom hole assembly ("BHA") 31 is shown in the process of being lowered into tubular member 11. BHA 31 has a lower portion 33 that extends downward through sleeve 17. As shown in FIG. 2, lower portion 33 may have a drill bit 35 at its lower end. The lower portion 33 may also include other equipment, such as instruments for surveying, and directional drilling. BHA lower portion 33 has a maximum outer diameter that is less than the inner diameter of sleeve 17, providing a clearance for the passage of drill bit 35.

A profile 37 is formed on BHA 31 above drill bit 35. Profile 37 matches the contour of load shoulder 21. Profile 37 has a torque transfer portion 39 that is at the same angle relative to axis 16 as torque transfer portion 23 of load shoulder 21. Profile 37 has an axial load transfer portion 41 that comprises a helical edge sloping from the lower terminus of torque transfer portion 39 to the upper terminus of torque transfer portion 39. Axial load transfer portion 41 extends 360 degrees and has the same helical angle as load shoulder axial load transfer portion 29. The length of torque transfer portion 39 is the same as the length of torque transfer portion 23 of load shoulder 21. The outer diameter of profile 37 may be slightly less than the outer diameter of sleeve 17 in order to provide a clearance as BHA 31 is being lowered into tubular member 11. Alternately, it could have the same outer diameter as sleeve 17 if sleeve 17 were located in a smaller diameter portion of bore 13.

Figure 5:
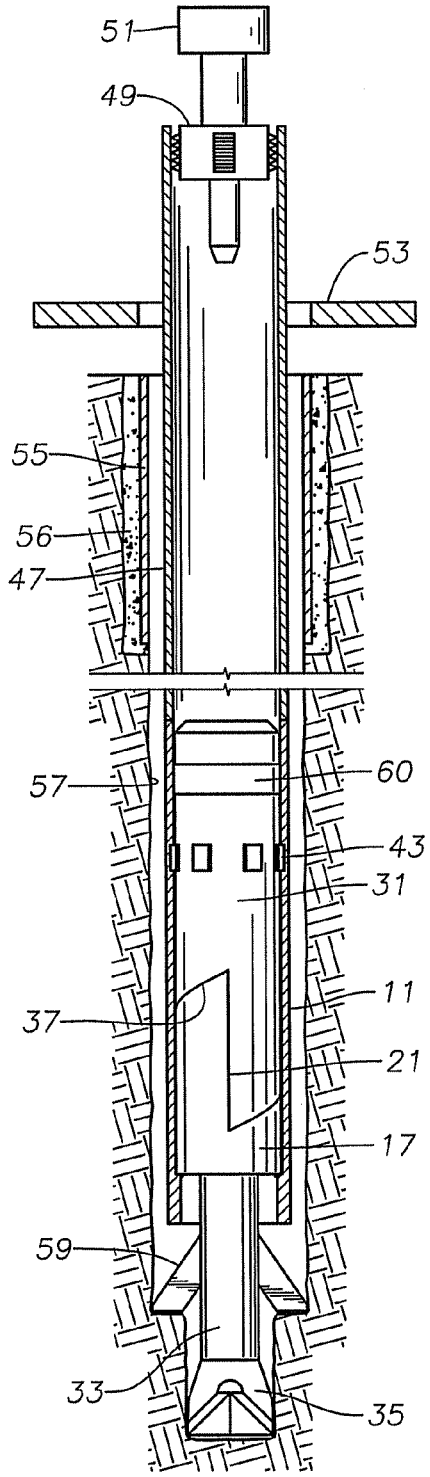
FIG. 5 is a schematic view of the apparatus of FIG. 1, shown connected into a casing string for casing-while-drilling operations.

Referring to FIG. 5, the upper portion of BHA 31 preferably comprises a connector with a latch 43 that is actuated to engage a recess 45 (FIG. 1) in bore 13 when BHA profile 37 has fully landed on load shoulder 21. FIG. 5 illustrates tubular member 11 secured into and forming part of a casing string 47. Casing string 47 is supported at its upper end by a casing gripper 49. Casing gripper 49 may grip the interior of casing string 47. Alternately, it could grip the exterior of casing string 47. Casing gripper 49 secures to a top drive 51, which is part of a drilling rig that will move top drive 51 up and down a derrick. Top drive 51 also causes rotation of casing gripper 49, which in turn imparts rotation to casing string 47. Top drive 51 and casing gripper 49 will be located above a rig floor 53 of the drilling rig.

In the example of FIG. 5, a first string of casing 55 has already been installed and cemented in place with cement 56. BHA 31 is installed within casing string 47, with drill bit 35 protruding below. A seal 60 seals between the upper portion of BHA 31 and tubular member 11. An underreamer 59 springs out from a retracted position and bores a larger diameter of borehole 57 than drill bit 35. While drilling, the operator will also pump drilling fluid down casing string 47, which flows out drill bit 35 and returns back to the surface in the annulus surrounding casing string 47.

In the operation of the invention, the operator may need to trip out BHA 31 from the position of FIG. 5 to replace components such as drill bit 35. The tripping can be performed by several means, including lowering a work string, such drill pipe or a wireline, through casing string 47 to engage the upper end of BHA 31. Alternately, BHA 31 could be pumped upward by reverse circulation of drilling fluid. Latch 43 may be released by the work string or by pumping down a release tool. BHA 31 brings along with it drill bit 35 as it moves to the surface while load shoulder 21 remains in place. When lowering BHA 31 back into casing string 47, profile 37 on BHA 31 will land on load shoulder 21. Normally, it will not be properly aligned or oriented with load shoulder 21. However, the helical portions 29 and 41 will slide against one another, causing BHA 31 to rotate until the axial load transfer portions 41 are aligned. BHA 31 will then slide downward into full makeup as illustrated in FIGS. 2 and 5. Load shoulder 21 will support the weight of BHA 31 until drill bit 35 engages the bottom of borehole 57. The operator then causes top drive 51 to rotate casing string 47. Torque will be transferred from casing string 47 through load shoulder torque transfer portion 23 to BHA torque transfer portion 39. The torque is thus imparted to the BHA lower portion 33 and drill bit 35.

Figure 6:
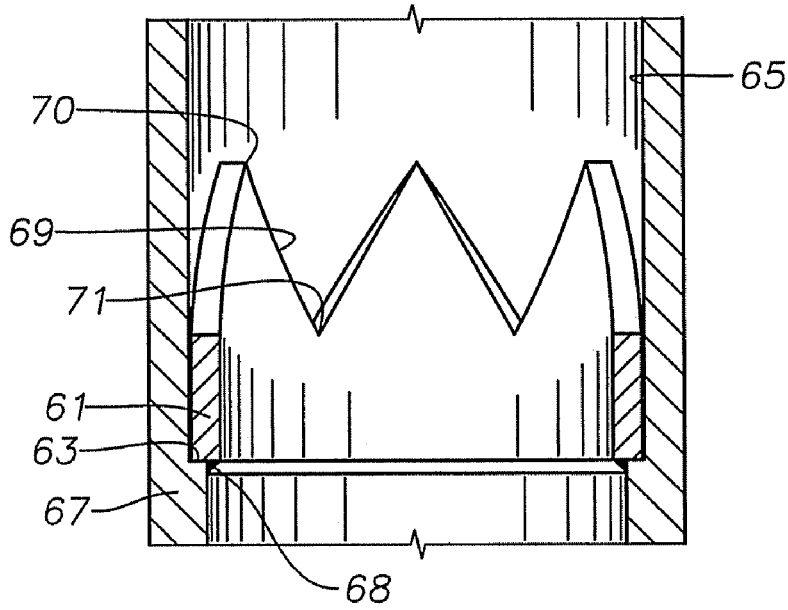
FIG. 6 is a side view of an alternate embodiment of a sleeve having a load shoulder in accordance with this invention, the sleeve being mounted in a tubular member that is shown in cross-section.

FIG. 6 illustrates another embodiment of a load shoulder that will transmit torque. In this embodiment, a sleeve 61 is mounted on a no-go shoulder 63 in a bore 65 of tubular member 67. Sleeve 61 may be fixed in place by a variety of means, including a weld 68. Sleeve 61 rotates with tubular member 67 and is prevented from axial movement relative to tubular member 67. Sleeve 61 has a load shoulder that has a saw-tooth configuration with peaks and valleys forming teeth. The flanks between the valleys and peaks serve as torque transfer portions 69. The valleys serve as axial load transfer portions 71. In this example, the triangular shape of each tooth is equilateral, thus torque may be transmitted both in clockwise and counterclockwise directions. Half of the torque transfer portions 69 face generally into one direction of rotation and the other half face generally in the opposite direction. As in the first embodiment, rather than a separate sleeve 61, the torque transfer portions 69 and axial load transfer portions 70 could be formed by directly machining bore 65.

The BHA (not shown) for the embodiment of FIG. 6 will have an identical sawtooth profile. The inclined torque transfer portions 69 will transfer torque to the BHA even though not parallel to the axis of tubular member 67 because the BHA will have a latch that prevents upward movement of the BHA relative to sleeve 61.

Figure 7:
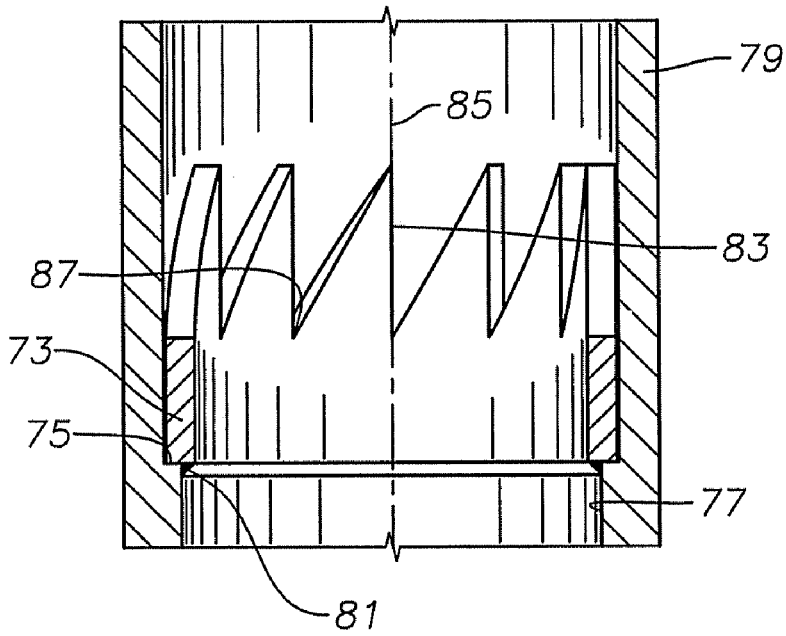
FIG. 7 is a side view of another embodiment of a sleeve having a load shoulder in accordance with this invention, the sleeve being shown mounted in a tubular member that is shown in cross-section.

In the example of FIG. 7, the sleeve 73 is fastened on a no-go shoulder 75 formed in a bore 77 of a tubular member 79. As in the other embodiments, a weld 81 illustrates one method of attaching sleeve 73 so that it will rotate in unison with tubular member 79. The load shoulder of sleeve 73 also has a sawtooth shape, but the flanks or torque transfer portions 83 are straight edges that are parallel with axis 85. The opposite flank of each tooth is inclined, forming an isosceles triangle shape for each tooth. The axial load transfer portions 87 comprise the base or lower terminus of each torque transfer portion 83.

The various embodiments disclose load shoulders that not only support the weight of a tool being lowered into a well bore, but also will transmit torque between the tool and the tubular member.

While the invention has been shown in only a few of its forms, it should be apparent to those skilled in the art that it is not so limited but it is susceptible to various changes without departing from the scope of the invention.

The invention claimed is:

1. A well apparatus for performing casing while drilling, comprising:

a tubular member having a bore, a longitudinal axis, and an upper end for connection to a casing string;

a load shoulder within the bore;

the load shoulder having a torque transferring portion extending from a lower terminus to an upper terminus;

the load shoulder having an axial force transferring portion that faces upward;

a bottom hole assembly for lowering through the casing string, the bottom hole assembly having a profile that lands on the load shoulder;

the profile having a torque transferring portion that mates in flush contact with the torque transferring portion of the load shoulder so that torque imposed on the casing string transfers to the bottom hole assembly; and the profile having an axial load transferring portion that mates in flush contact with the axial load transferring portion of the load shoulder for transferring weight of the bottom hole assembly to the casing string.

2. The well apparatus according to claim 1, wherein the load shoulder is formed on a sleeve that is rigidly attached to the tubular member within the bore.

3. The well apparatus according to claim 1, wherein the torque transferring portion is substantially parallel with an axis of the tubular member.

4. The well apparatus according to claim 1, wherein the axial force transferring portion comprises a helical surface extending 360 degrees around the axis from the lower terminus to the upper terminus.

5. The well apparatus according to claim 1, wherein the load shoulder has a sawtooth configuration, with peaks and valleys comprising the upper terminus and the lower terminus, respectively.

6. The well apparatus according to claim 1, wherein:

the bottom hole assembly has a lower portion extending downward from the profile and through the bore of the tubular member below the load shoulder; and a drill bit is attached to a lower end of the bottom hole assembly.

7. The well apparatus according to claim 1, further comprising a latch mounted to the bottom hole assembly, the latch axially locking the bottom hole assembly relative to the tubular member.

8. The well apparatus according to claim 1, wherein a length of the torque transferring portion of the profile is equal to a length of the torque transferring portion of the load shoulder, and the torque transferring portion of the profile extends along a line substantially parallel with the axis.

9. A well apparatus, comprising:

a tubular member for location in a wellbore, the tubular member having a bore;

a load shoulder within the bore;

the load shoulder having a torque transferring portion extending upward from a lower terminus to an upper terminus, the torque transferring portion facing generally into a selected rotational direction relative to an axis of the tubular member; and the load shoulder having an axial force transferring portion that extends along a helical angle around the axis from the lower terminus to the upper terminus.

10. The well apparatus according to claim 9, wherein the load shoulder is formed on a sleeve that is rigidly attached to the tubular member within the bore.

11. The well apparatus according to claim 10, wherein the sleeve has an outer diameter substantially equal to an inner diameter of the portion of the bore in which it is located.

12. The well apparatus according to claim 9, wherein the torque transferring portion extends along a line substantially parallel with the axis of the tubular member.

13. The well apparatus according to claim 9, wherein the torque transferring portion and the axial force transferring portion have a same radial thickness relative to the axis of the tubular member.

14. The well apparatus according to claim 9, wherein the upper terminus is located directly above the lower terminus.

15. The well apparatus according to claim 9, wherein the axial force transferring portion extends 360 degrees around the axis from the lower terminus to the upper terminus.

16. The well apparatus according to claim 9, further comprising:

a tool having a profile that mates with the load shoulder when lowered into engagement with the load shoulder, the profile having a torque transferring portion that abuts the torque transferring portion of the load shoulder, the profile having an axial force transferring portion that abuts the axial force transferring portion of the load shoulder.

17. The well apparatus according to claim 16, wherein:

the torque transferring portion of the profile of the tool has a same length and extends at a same angle relative to the axis as the torque transferring portion of the load shoulder; and the axial force transferring portion of the profile of the tool is at the same helical angle as the axial force transmitting portion of the load shoulder.

18. A method of drilling with a casing string, comprising:

(a) providing a tubular member with an internal load shoulder having a torque transferring portion and an axial force transferring portion;

(b) connecting the tubular member to the casing string;

(c) providing a bottom hole assembly with a drill bit and a profile having a torque transferring portion and an axial force transferring portion;

(d) lowering the bottom hole assembly into the casing string and landing the profile on the load shoulder with the drill bit protruding past a lower end of the casing string;

(e) transferring weight of the bottom hole assembly from the axial force transferring portion of the profile to the axial load transferring portion of the load shoulder; and (f) rotating the casing string and transferring torque from the casing string through the torque transferring portion of the load shoulder to the torque transferring portion of the profile to cause the bottom hole assembly to rotate.

19. The method according to claim 18, wherein step (d) further comprises allowing the bottom hole assembly to rotate as needed relative to the tubular member to orient the profile relative to the load shoulder.

20. The method according to claim 18, further comprising latching the bottom hole assembly within the tubular member to prevent upward movement of the bottom hole assembly relative to the casing string while drilling.

* * * * *